US009574342B2

(12) United States Patent
Clark

(10) Patent No.: US 9,574,342 B2
(45) **Date of Patent: *Feb. 21, 2017**

(54) METHOD AND SYSTEM FOR THERMAL BARRIER INSTALLATION

(71) Applicant: Oldcastle BuildingEnvelope, Inc., Plano, TX (US)

(72) Inventor: Phil Clark, Terrell, TX (US)

(73) Assignee: Oldcastle BuildingEnvelope, Inc., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/830,474

(22) Filed: Aug. 19, 2015

(65) Prior Publication Data

US 2015/0354206 A1 Dec. 10, 2015

Related U.S. Application Data

(63) Continuation of application No. 13/675,773, filed on Nov. 13, 2012, now Pat. No. 9,133,614.

(Continued)

(51) Int. Cl.
*E04B 1/68* (2006.01)
*E04B 1/78* (2006.01)

(Continued)

(52) U.S. Cl.
CPC ..... *E04B 1/6801* (2013.01); *E04B 1/76* (2013.01); *E04B 1/78* (2013.01); *E04B 2/00* (2013.01); *E06B 3/2632* (2013.01); *E06B 3/26301* (2013.01); *E06B 3/26303* (2013.01); *E06B 3/26343* (2013.01); *E06B 3/273* (2013.01);

(Continued)

(58) Field of Classification Search
CPC .... E06B 3/273; E06B 3/2735; E06B 3/26303; E06B 3/26307
See application file for complete search history.

(56) References Cited

U.S. PATENT DOCUMENTS 3,420,026 A * 1/1969 Nolan ..... E06B 3/26347 29/509
3,441,995 A * 5/1969 Nolan ..... B21D 49/00 29/416

(Continued)

FOREIGN PATENT DOCUMENTS

EP 1580387 A2 9/2005
WO WO-2013074532 A1 5/2013

OTHER PUBLICATIONS

Young, Lee W., "International Search Report for PCT/US2012/064847", as mailed Feb. 5, 2013, 4 pages.

*Primary Examiner* — Ryan Kwiecinski
(74) *Attorney, Agent, or Firm* — Winstead PC

(57) ABSTRACT

An insulation system including a first retention member having a first channel, a second retention member having a second channel, and a thermal bridge. The thermal bridge includes a first finger and a second finger. The first finger is received into the first channel and the second finger is received into the second channel. The system further includes a first locking tab associated with the first channel for securing the first finger and a second locking tab associated with the second channel for securing the second finger. The thermal bridge substantially reduces conductive heat transfer between the first retention member and the second retention member.

10 Claims, 9 Drawing Sheets

Related U.S. Application Data

(60) Provisional application No. 61/559,417, filed on Nov. 14, 2011.

(51) Int. Cl.

| | |
|---|---|
| ***E06B 3/263*** | (2006.01) |
| ***E06B 3/273*** | (2006.01) |
| ***E04B 1/76*** | (2006.01) |
| ***E04B 2/00*** | (2006.01) |
| ***E06B 3/54*** | (2006.01) |

(52) U.S. Cl.
CPC .. *E06B 3/5454* (2013.01); *E06B 2003/26332* (2013.01)

(56) References Cited

U.S. PATENT DOCUMENTS 3,815,216 A * 6/1974 Brockway ..... B21D 47/04 264/45.9
3,823,524 A * 7/1974 Weinstein ..... E06B 3/267 264/261
3,992,769 A * 11/1976 Jackson ..... B23P 11/00 29/416
4,096,678 A * 6/1978 Diels ..... B23P 11/00 29/416
4,188,705 A * 2/1980 Jackson ..... B21D 53/74 29/509
4,231,207 A * 11/1980 Kern ..... E06B 3/273 49/DIG. 1
4,245,384 A * 1/1981 Egerer ..... E06B 3/273 29/241
4,287,658 A * 9/1981 Egerer ..... B21D 47/04 29/243.58
4,642,870 A * 2/1987 Schulz ..... E06B 3/273 29/433
4,786,539 A * 11/1988 Grether ..... E06B 3/26307 428/68
5,469,683 A * 11/1995 McKenna ..... E06B 3/273 52/204.591
6,338,227 B1 1/2002 Finke
7,913,470 B2 * 3/2011 Siodla et al. ..... E06B 3/26301 403/331
2005/0091830 A1 * 5/2005 Van Den Bulcke ... B21D 53/74 29/514
2005/0115193 A1 * 6/2005 Brunnhofer ..... E06B 3/2632 52/717.02
2007/0028538 A1 2/2007 Woelfert
2009/0229202 A1 * 9/2009 Dampierre ..... E06B 3/26305 52/213

* cited by examiner

METHOD AND SYSTEM FOR THERMAL BARRIER INSTALLATION

CROSS-REFERENCE TO RELATED APPLICATIONS

This application is a continuation of U.S. patent application Ser. No. 13/675,773 filed Nov. 13, 2012. U.S. patent application Ser. No. 13/675,773 claims priority to U.S. Provisional Patent Application No. 61/559,417, filed Nov. 14, 2011. U.S. patent application Ser. No. 13/675,773 and U.S. Provisional Patent Application No. 61/559,417 are incorporated herein by reference.

BACKGROUND

Field of the Invention

The present application relates generally to structural building components and more particularly, but not by way of limitation, to methods and systems for thermal insulation of structural building members to reduce heat transfer.

History of the Related Art

The trend of increasing prices for natural gas, electricity, and other heating fuels have made energy efficiency a high-profile issue. In buildings, thermal energy may be lost to the atmosphere through, for example, conduction, radiation, or convection. Radiation is a transfer of thermal energy through electromagnetic waves. Convection takes place as a result of molecular movement, known as currents or convective looping, within fluids. A common mode of convection occurs as a result of an inverse relationship between a fluid's density and temperature. Typically, such type of convection is also referred to as "natural" or "free" convection in which heating of a fluid results in a decrease in the fluid's density. Denser portions of the fluid fall while less dense portions of the fluid rise thereby resulting in bulk fluid movement. A common example of natural convection is a pot of boiling water in which hot (and less dense) water at a bottom of the pot rises in plumes and cooler (more dense) water near the top of the pot sinks. The primary means of thermal energy loss across an un-insulated air-filled space is natural convection.

Conduction is a transfer of thermal energy between regions of matter due to a temperature gradient. Heat is transferred by conduction when adjacent atoms vibrate against one another. Conduction is the most significant form of heat transfer within a solid or between solid objects in thermal contact. Conduction is more pronounced in solids due to a network of relatively fixed spatial relationships between atoms. Conductivity varies with a material's density. Metals such as, for example, copper and aluminum, are typically the best conductors of thermal energy.

Thermal efficiency of building components are often expressed in terms of thermal resistance ("R-value") and thermal transmission ("U-factor"). R-value is a measurement of thermal conductivity and measures a product's resistance to heat loss. In common usage, R-value is used to rate building materials such as, for example, insulation, walls, ceilings, and roofs that generally do not transfer significant amounts of heat by convection or radiation. A product with a higher R-value is considered more energy efficient.

Of particular concern in buildings are windows and doors. In particular, windows come in contact with the environment in ways that walls and solid insulation do not. As a result, windows are strongly affected by convection as well as radiation. For this reason, U-factor is commonly used as a measure of energy efficiency of windows. U-factor measures a rate of total heat transfer through a product (including heat transfer by convection and radiation). A product with a lower U-factor is considered more energy efficient. In recent years, federal, state, and municipal building codes often specify minimum R-values and U-factors for building components.

SUMMARY

The present application relates generally to structural building components. In one aspect, the present invention relates to a method of installing a thermal bridge. The thermal bridge includes a body region, a first finger, and a second finger. The method includes placing an assembly jig between an inner aspect of a first channel disposed on a first retention member and an inner aspect of a second channel disposed on a second retention member. The first channel includes a first locking tab associated therewith and the second channel includes a second locking tab associated therewith. The method further includes inserting the first finger into the first channel and inserting the second finger into the second channel. The first locking tab is closed about the first finger and the second locking tab is closed about the second finger. The assembly jig provides proper alignment during closing of the first locking tab and second locking tab. The thermal bridge substantially reduces conductive heat transfer between the first retention member and the second retention member.

In another aspect, the present invention relates to an insulation system. The insulation system includes a first retention member having a first substantially-planar portion and a first channel. The insulation system also includes a second retention member having a second substantially-planar portion and a second channel. The insulation system also includes a thermal bridge having a body region, a first finger, and a second finger. The first finger is received into the first channel and the second finger is received into the second channel. A first locking tab is associated with the first channel and secures the first finger. A second locking tab is associated with the second channel and secures the second finger. The thermal bridge substantially reduces conductive heat transfer between the first retention member and the second retention member.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1A:
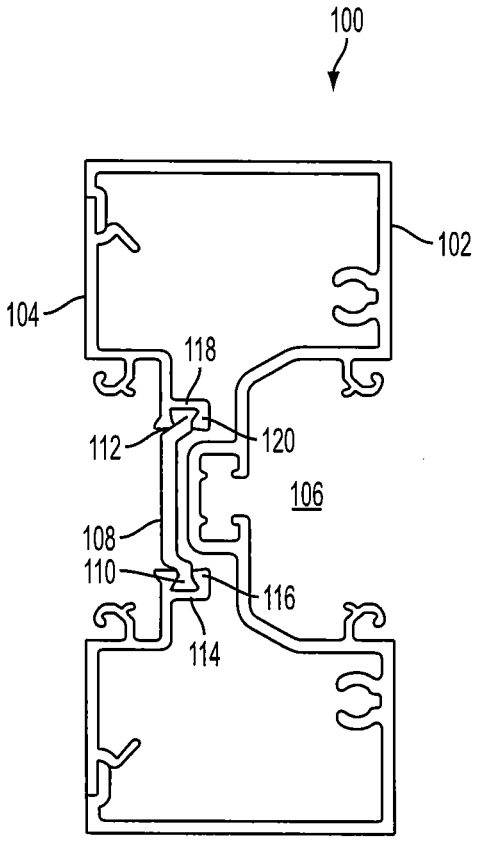
FIG. 1A PRIOR ART
FIG. 1A is a cross-sectional view of a prior-art structural member.

FIG. 1A is a cross-sectional view of a prior-art structural member. A structural member 100 includes a receptacle portion 102, a snap-in portion 104, and a thermal bridge 108. The receptacle portion 102 is typically formed with a channel 106. The channel 106 receives and holds a material such as, for example, architectural glass. Both the receptacle portion 102 and the snap-in portion 104 are typically formed of a high-strength material such as, for example, extruded aluminum. The thermal bridge includes a first finger 110 and a second finger 112. The first finger 110 is secured in a first channel 114 by a first locking tab 116 and the second finger 112 is secured in a second channel 118 by a second locking tab 120.

Figure 1B:
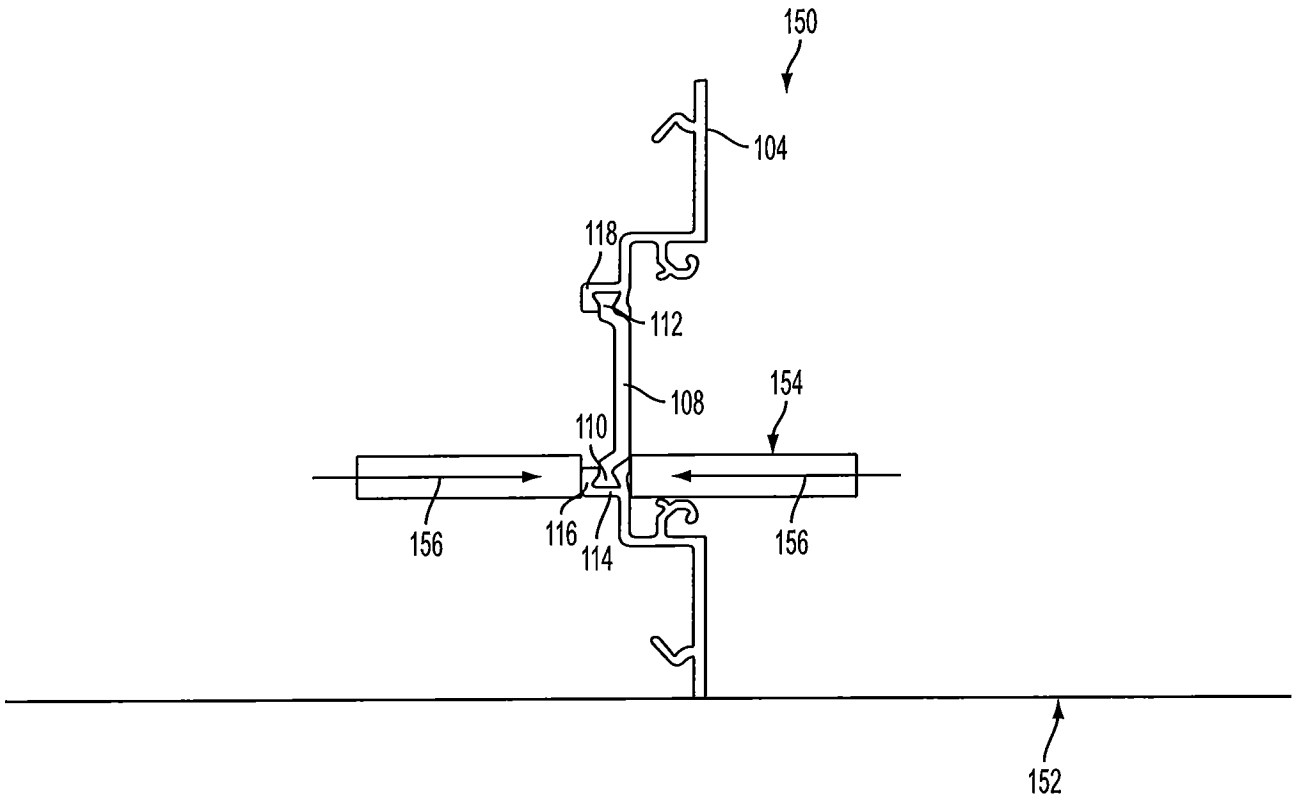
FIG. 1B PRIOR ART
FIG. 1B is a cross-sectional view of a prior-art assembly apparatus.

FIG. 1B is a cross-sectional view of a prior-art assembly apparatus. An assembly apparatus 150 includes an assembly table 152 and a pair of oppositely-disposed crimping wheels 154. During operation, the snap-in portion 104 is arranged on the assembly table 152 such that the first channel 114 is positioned between the pair of oppositely-disposed crimping wheels 154. The thermal bridge 108 is positioned such that the first finger 110 is inserted into the first channel 114. The pair of oppositely-disposed crimping wheels 154 close the first locking tab 116 around the first finger 110 thereby securing the thermal bridge 108. After the first finger 110 is secured in the first channel 114, the snap-in portion 104 is turned over and the process is repeated to secure the second finger 112 in the second channel 118. As shown in FIG. 1B, the snap-in portion 104 is positioned on the assembly table 152 on edge. It has been observed that such arrangements may be unstable, making alignment of the first channel 114 and the second channel 118 between the pair of oppositely-disposed crimping wheels 154 difficult. Further, as shown herein, applied forces 156 are oriented in a direction generally orthogonally to the first channel 114 and the second channel 118. The applied forces 156 may result in bending or other deformation of the first channel 114 or the second channel 118.

Figure 2:
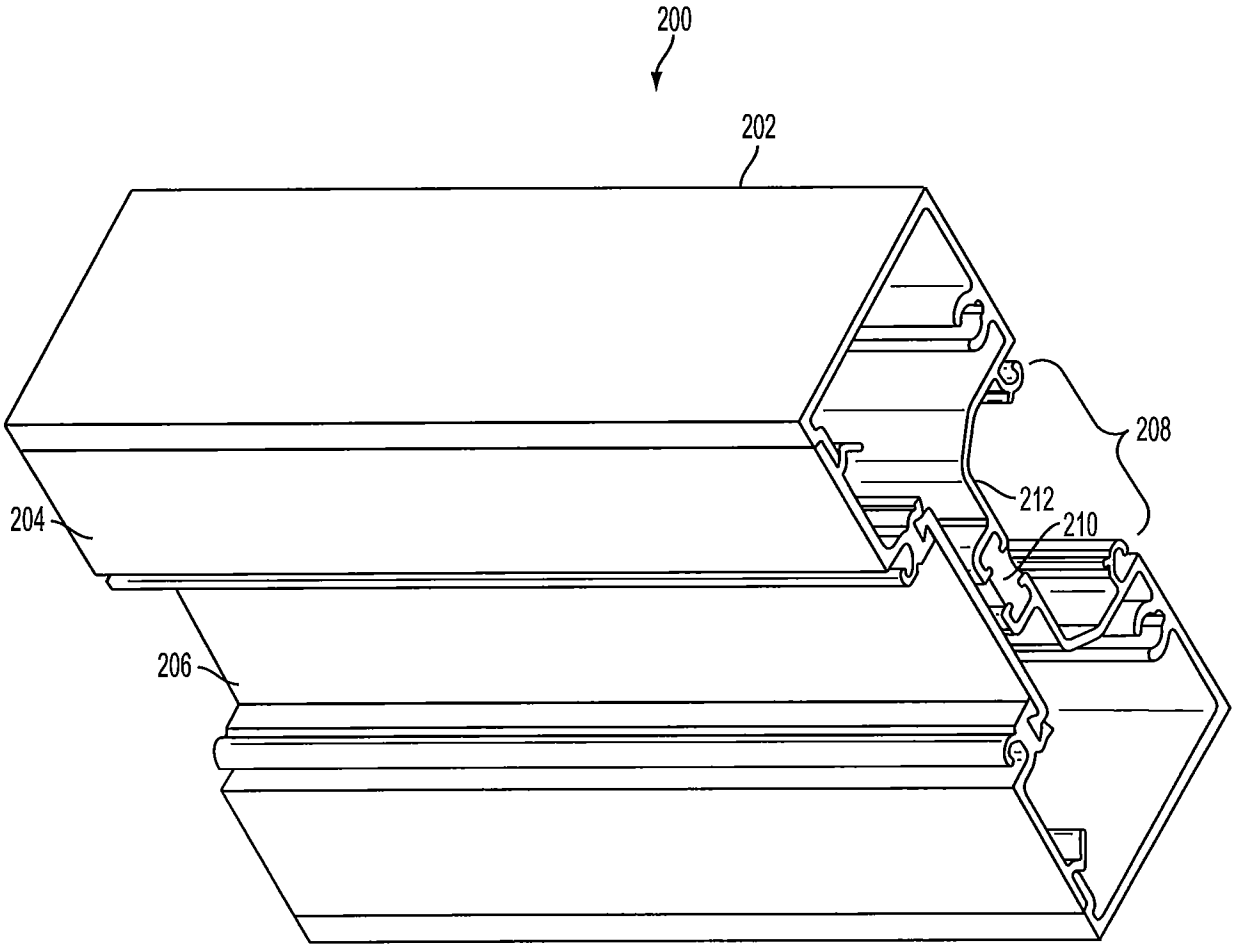
FIG. 2 is a perspective view of a structural member according to an exemplary embodiment.

Referring now to FIG. 2, there is shown a perspective view of a structural member according to an exemplary embodiment. The structural member 200 includes a receptacle portion 202, a snap-in portion 204, and a thermal bridge 206. The receptacle portion 202 is formed with a channel 208. In a typical embodiment, the channel 208 receives a material such as, for example, architectural glass, for securement therein. In a typical embodiment, the receptacle portion 202 is formed of a high-strength material such as, for example, extruded aluminum; however, in various alternative embodiments, other materials may be used. In a typical embodiment, the receptacle portion 202 generally includes a thermally-conductive perimeter 212. A thermal barrier 210 is formed in the thermally-conductive perimeter 212 of the receptacle portion 202. In a typical embodiment, the thermal barrier 210 includes a plug formed of a substantially thermally-non-conductive material such as, for example, poly-vinyl chloride (PVC), plastic, rubber, or other insulating material. The thermal barrier 210 interrupts the thermally-conductive perimeter 212 and provides insulation against conductive heat transfer across the receptacle portion 202.

Figure 3A:
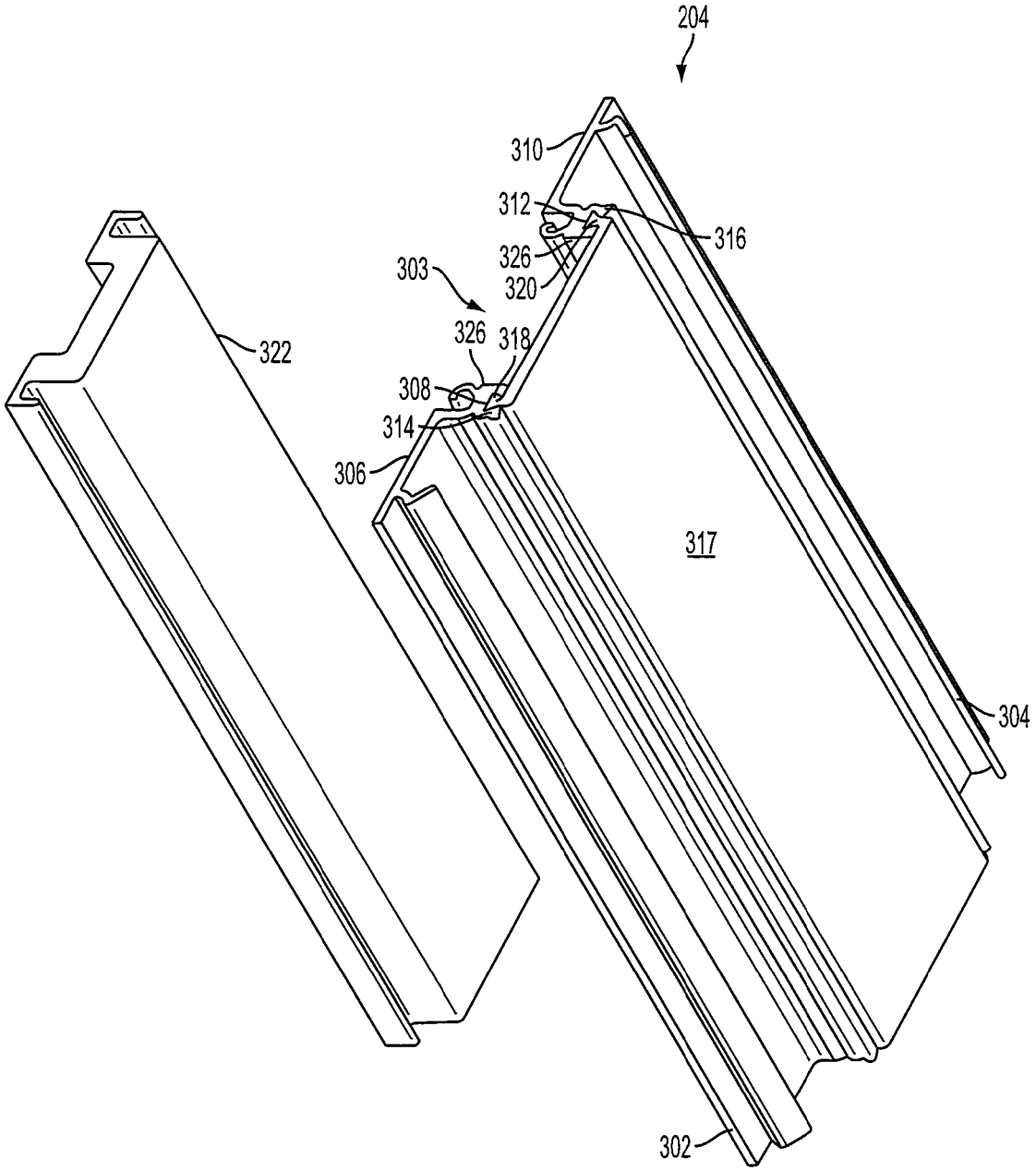
FIG. 3A is a partially-exploded perspective view of a snap-in portion and an assembly jig according to an exemplary embodiment.
Figure 3B:
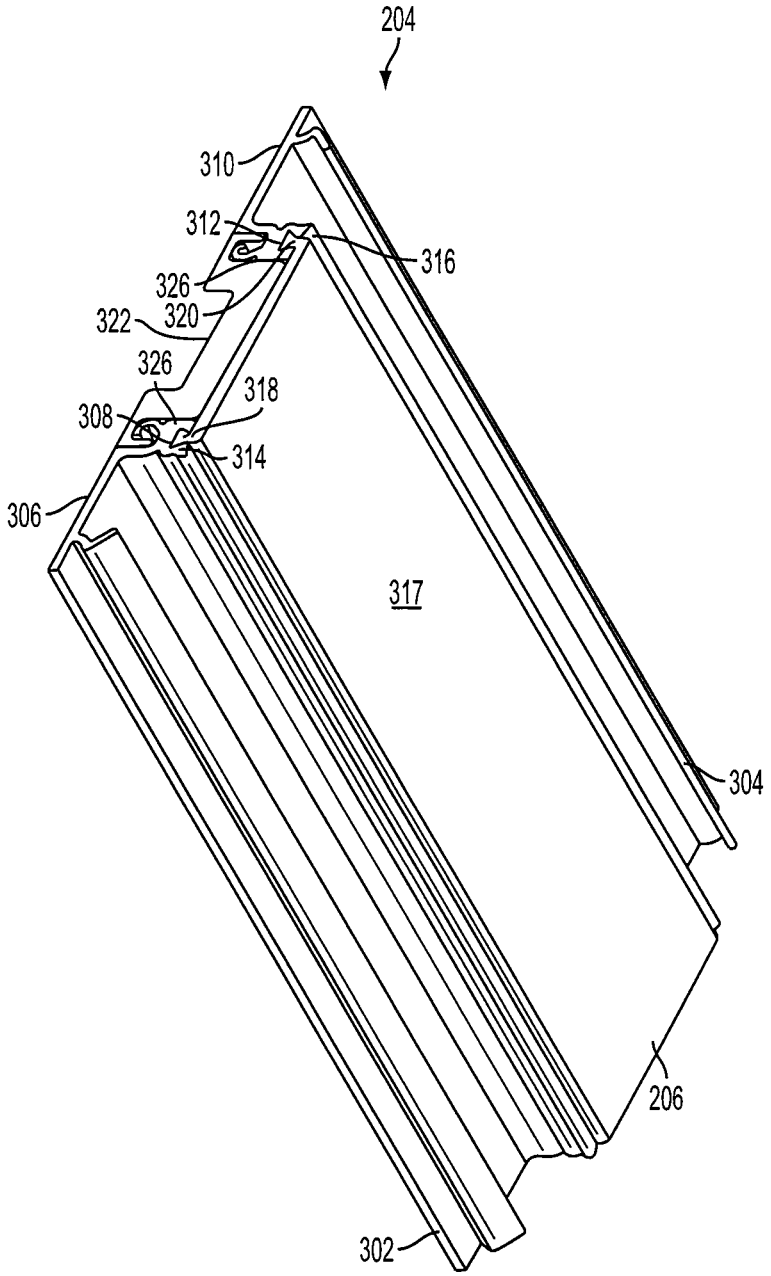
FIG. 3B is a perspective view of the snap-in portion and the assembly jig of FIG. 3A according to an exemplary embodiment.

FIGS. 3A and 3B are perspective views of a snap-in portion according to an exemplary embodiment. The snap-in portion 204 includes a first retention member 302 and a second retention member 304. A glazing pocket 303 is defined between the first retention member 302 and the second retention member 304. In a typical embodiment, the first retention member 302 and the second retention member 304 are formed of a high-strength material such as, for example, extruded aluminum. Thus, in a typical embodiment, the first retention member 302 and the second retention member 304 are thermally conductive. The first retention member 302 includes a first substantially-planar portion 306 and a first channel 308 formed generally orthogonally to the first substantially-planar portion 306. The second retention member 304 includes a second substantially-planar portion 310 and a second channel 312 formed generally orthogonally to the second substantially-planar portion 310. Orientation of the first channel 308 and the second channel 312 generally orthgonally to the first substantially-planar portion 306 and the second substantially-planar portion 310, respectively, allows greater room for placement of the thermal barrier 210 (shown in FIG. 2). In a typical embodiment, the first channel 308 and the second channel 312 are substantially parallel to each other. The first channel 308 includes a first locking tab 314 and the second channel 312 includes a second locking tab 316. An assembly jig 322 is removably disposed in a space between the first retention member 302 and the second retention member 304. As shown in FIG. 3B, the assembly jig 322 contacts and supports an inner aspect 326 of the first channel 308 and the second channel 312. In a typical embodiment, the assembly jig 322 maintains proper spacing between the first retention member 302 and the second retention member 304. Proper spacing between the first retention member 302 and the second retention member 304 ensures that the snap-in portion 204 is properly sized to be received into the receptacle portion 202 (shown in FIG. 2). In addition, proper spacing between the first retention member 302 and the second retention member 304 ensures that the glazing pocket 303 (shown in FIG. 3A) is properly sized. Proper sizing of the glazing pocket 303 ensures that a material such as, for example, architechtural glass is secured therein with the proper tolerances.

Still referring to FIGS. 3A and 3B, the thermal bridge 206 includes a body 317, a first finger 318, and a second finger 320. The first finger 318 and the second finger 320 are formed generally orthogonally to the body 317. The thermal bridge 206 is disposed between the first retention member 302 and the second retention member 304. Thus, the thermal bridge 206 interrupts conductive heat transfer between the first retention member 302 and the second retention member 304 and provides insulation against conductive heat transfer across the snap-in portion 204. In a typical embodiment, the thermal bridge 206 is formed of a substantially non-thermally-conductive material such as, for example, poly-vinyl chloride (PVC), plastic, rubber, or other insulating material. The first finger 318 is inserted into the first channel 308 and the second finger 320 is inserted into the second channel 312. In various embodiments, an interior surface of the first channel 308 is knurled to provide frictional engagement between the first channel 308 and the first finger 318. Likewise, in various embodiments, an interior surface of the second channel 312 is knurled to provide frictional engagement between the second channel 312 and the second finger 320.

Still referring to FIGS. 3A and 3B, after the first finger 318 is inserted into the first channel 308, the first locking tab 314 is closed around the first finger 318 through a process such as, for example, crimping or roll forming. Likewise, after the second finger 320 is inserted into the second channel 312, the second locking tab 316 is closed around the second finger 320 through a process such as, for example, crimping or roll forming. As shown in FIG. 3B, the assembly jig 322 supports the inner aspect 326 of the first channel 308 and the second channel 312. The assembly jig 322 thus prevents bending of the first channel 308 and the second channel 312 during closure of the first locking tab 314 and the second locking tab 316. In addition, parallel arrangement of the first channel 308 and the second channel 312 allows the first locking tab 314 and the second locking tab 316 to be closed substantially simultaneously. Thus, the thermal bridge 206 may be assembled to the first retention member 302 and the second retention member 304 with a single operation. In a typical embodiment, the thermal bridge 206 substantially reduces conductive heat transfer between the first retention member 302 and the second retention member 304.

Figure 4:
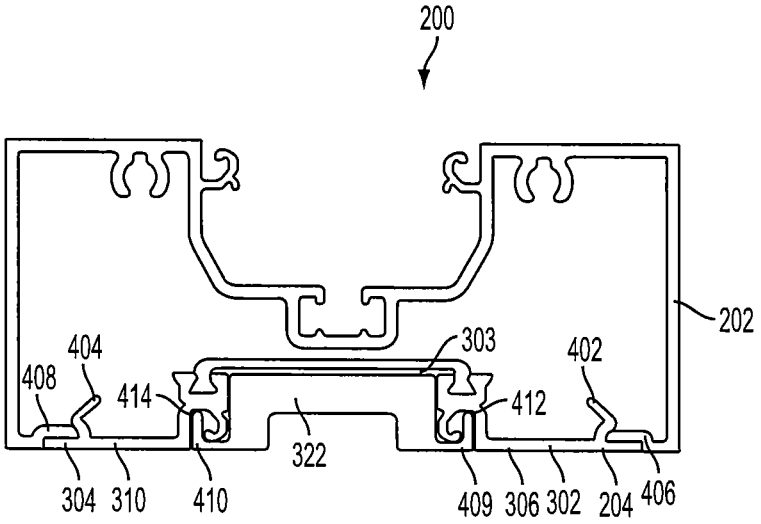
FIG. 4 is a cross-sectional view of the structural member of FIG. 2 showing an assembly jig according to an exemplary embodiment.

FIG. 4 is a cross-sectional view of a structural member according to an exemplary embodiment. The snap-in portion 204 is received into the receptacle portion 202 and secured thereto by a first clip 402 and a second clip 404. The first clip 402 is disposed on the first substantially-planar portion 306 of the first retention member 302. The first clip 402 engages a first tongue 406 disposed on the receptacle portion 202. The second clip 404 is disposed on the second substantially-planar portion 310 of the second retention member 304. The second clip 404 engages a second tongue 408 disposed on the receptacle portion 202.

Still referring to FIG. 4, the assembly jig 322 includes a first lip section 409 and a second lip section 410. The first lip section 409 is received into a first groove 412 on the first retention member 302. Likewise the second lip section 410 is received into a second groove 414 on the second retention member 304. In a typical embodiment, the thermal bridge 206 substantially reduces conductive heat transfer between the first retention member 302 and the second retention member 304. The assembly jig 322 is illustrated in FIG. 4 for purposes of clarity. In a typical embodiment, the assembly jig 322 is removed prior to assembly of the snap-in portion 204 to the receptacle portion 202.

Figure 5:
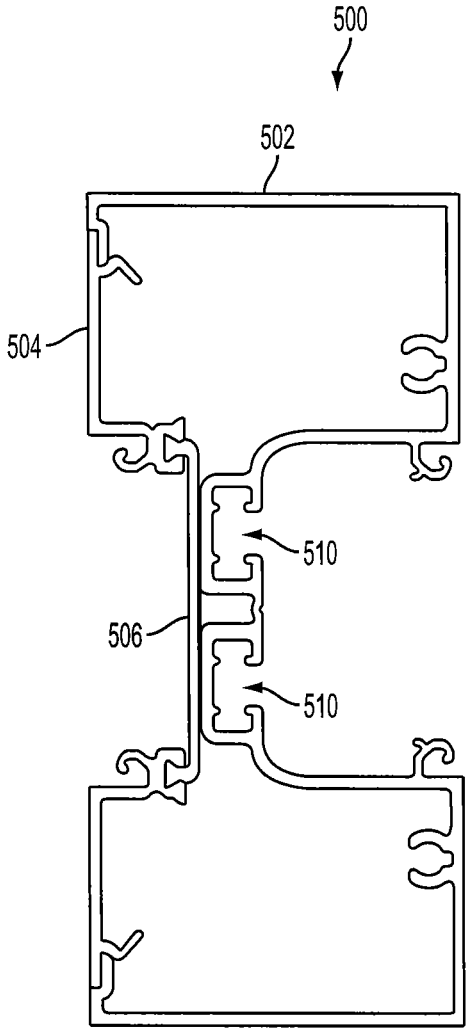
FIG. 5 is a cross-sectional view of a structural member including multiple thermal barriers according to an exemplary embodiment.

FIG. 5 is a cross-sectional view of a structural member according to an exemplary embodiment. A structural member 500 includes a receptacle portion 502, a snap-in portion 504, and a thermal bridge 506. In the embodiment shown in FIG. 5, two thermal barriers 510 are disposed in the receptacle portion 502. Further, in the embodiment shown in FIG. 5, the thermal bridge 506 is planar. In other respects, the structural member 500 is of similar construction to the structural member 200 (shown in FIG. 2). In a typical embodiment, the thermal barriers 510 provide increased insulation against conductive heat transfer across the receptacle portion 502. In addition, the thermal bridge 506 substantially reduces conductive heat transfer across the snap-in portion 504.

Figure 6:
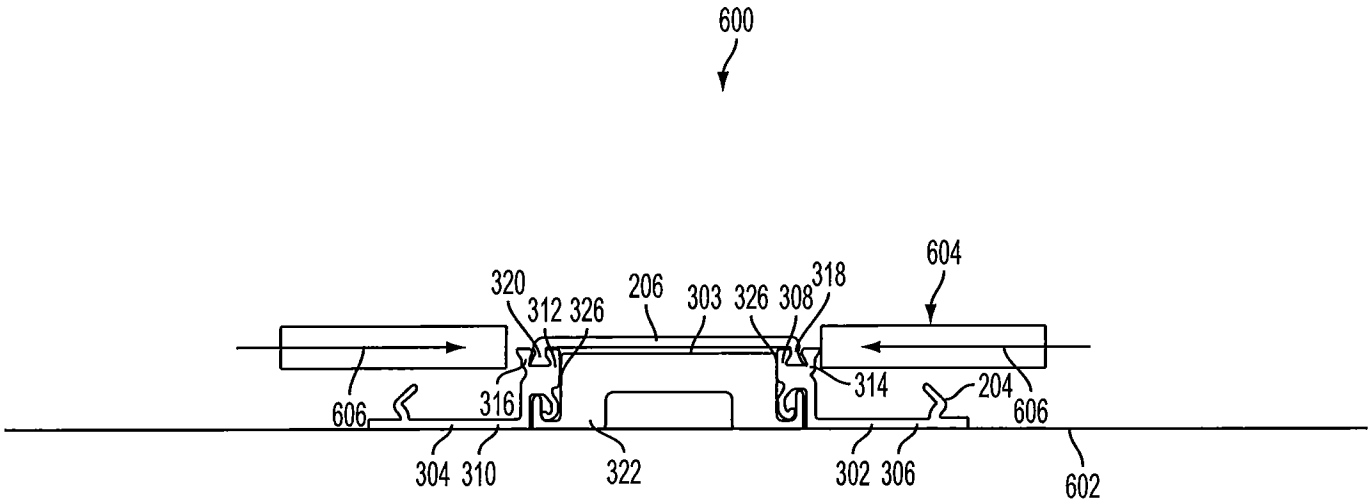
FIG. 6 is a cross-sectional view of an assembly apparatus according to an exemplary embodiment.

FIG. 6 is a cross-sectional view of an assembly apparatus according to an exemplary embodiment. An assembly apparatus 600 includes an assembly table 602 and a pair of oppositely-disposed crimping wheels 604. During operation, the first retention member 302 and the second retention member 304 are arranged on the assembly table 602 such that the first channel 308 and the second channel 312 are positioned between the pair of oppositely-disposed crimping wheels 604. The assembly jig 322 is positioned between the first retention member 302 and the second retention member 304. In a typical embodiment, the assembly jig 322 maintains proper spacing between the first retention member 302 and the second retention member 304. Proper spacing between the first retention member 302 and the second retention member 304 ensures that the snap-in portion 204 is properly sized to be received into the receptacle portion 202 (shown in FIG. 2). In addition, proper spacing between the first retention member 302 and the second retention member 304 ensures that the glazing pocket 303 is properly sized. Proper sizing of the glazing pocket 303 ensures that a material such as, for example, architectural glass is secured therein with the proper tolerances. The orthogonal orientation of the first channel 308 and the second channel 312 allows the first substantially-planar portion 306 and the second substantially-planar portion 310 to be placed flat upon the assembly table 602. Such an arrangement stabilizes the first retention member 302 and the second retention member 304 and allows support sufficient to maintain alignment of the first channel 308 and the second channel 312 between the pair of oppositely-disposed crimping wheels 604.

Still referring to FIG. 6, the thermal bridge 206 is arranged such that the first finger 318 is inserted into the first channel 308 and the second finger 320 is inserted into the second channel 312. After insertion of the first finger 318 and the second finger 320, the pair of oppositely-disposed crimping wheels 604 engage the first locking tab 314 and the second locking tab 316. In other embodiments, the first locking tab 314 and the second locking tab 316 may be closed by other methods such as, for example, pressing. The pair of oppositely-disposed crimping wheels 604 are moved along a length of the first retention member 302 and the second retention member 304 and simultaneously bend the first locking tab 314 and the second locking tab 316 around the first finger 318 and the second finger 320, respectively, thereby securing the thermal bridge 206. Simultaneous closure of the first tab and the second tab allows the thermal bridge 206 to be assembled to the first retention member 302 and the second retention member 304 with one pass through the pair of oppositely-disposed crimping wheels 604.

Still referring to FIG. 6, in a typical embodiment, applied forces 606 are oriented in a direction generally orthogonally to the first channel 308 and the second channel 312. The assembly jig 322 supports the inner aspect 326 of each of the first channel 308 and the second channel 312. Thus the assembly jig 322 prevents bending or other deformation of the first channel 308 and the second channel 312.

Figure 7:
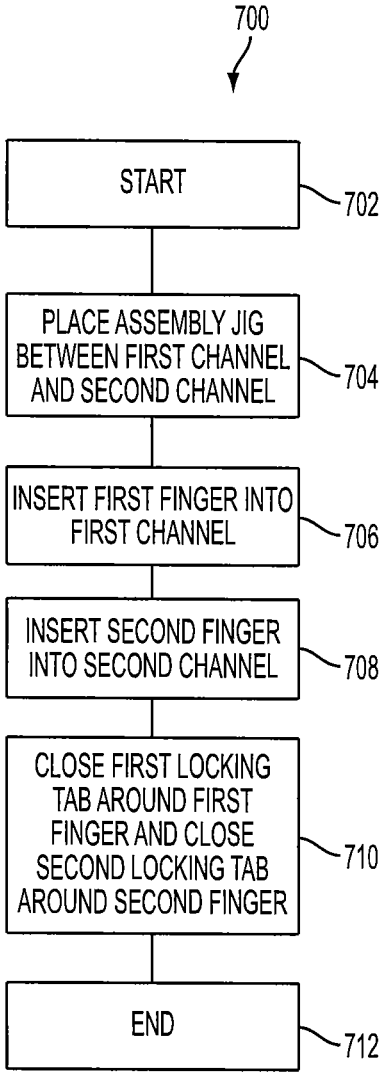
FIG. 7 is a flow diagram of a method of installing a thermal bridge according to an exemplary embodiment.

FIG. 7 is a flow diagram of a method of installing a thermal bridge according to an exemplary embodiment. A process 700 begins at step 702. At step 704, an assembly jig 322 is placed between an inner aspect 326 of a first channel 308 and an inner aspect 326 of a second channel 312. At step 706, a first finger 318, associated with a thermal bridge 206, is inserted into the first channel 308. At step 708, a second finger 320, associated with the thermal bridge 206, is inserted into the second channel 312. At step 710 a first locking tab 314, associated with the first channel 308, is closed around the first finger 318 and a second locking tab 316, associated with the second channel 312, is closed around the second finger 320. The first locking tab 314 and the second locking tab 316 are, in various embodiments, simultaneously closed through a process such as, for example, crimping or roll-forming. The process 700 ends at step 712.

Although various embodiments of the method and system of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. A method of installing a thermal bridge comprising a body region, a first finger, and a second finger, the method comprising:

supporting an inner aspect of a first channel disposed on a first retention member;

supporting an inner aspect of a second channel disposed on a second retention member;

maintaining a desired spacing between the first retention member and the second retention member;

inserting the first finger into the first channel;

inserting the second finger into the second channel;

securing the first finger within the first channel by compressing a first locking tab between a first wheel and a removable assembly jig;

securing the second finger within the second channel by compressing a second locking tab between a second wheel and the removable assembly jig;

wherein the supporting the first channel and the supporting the second channel comprises placing the removable assembly jig between the first channel and the second channel; and wherein the thermal bridge reduces conductive heat transfer between the first retention member and the second retention member.

2. The method of claim 1, wherein the securing the first finger and the securing the second finger comprises bending the first locking tab and bending the second locking tab.

3. The method of claim 2, wherein the first wheel and the second wheel are disposed opposite each other.

4. The method of claim 3, comprising applying, via the first wheel and the second wheel, a force generally orthogonally to the first channel and the second channel.

5. The method of claim 3, wherein the securing the first finger and the securing the second finger comprises moving the first wheel and the second wheel along a length of the first locking tab and the second locking tab.

6. The method of claim 1, wherein the compressing the first locking tab and the compressing the second locking tab occurs simultaneously.

7. The method of claim 1, wherein the first retention member comprises a first planar portion and the second retention member comprises a second planar portion.

8. The method of claim 7, comprising arranging the first planar portion and the second planar portion flat on an assembly table.

9. The method of claim 1, wherein the removable assembly jig maintains the desired spacing between the first retention member and the second retention member.

10. The method of claim 1, wherein the removable assembly jig reduces deformation of the first channel and the second channel.

* * * * *